US008653748B2

(12) United States Patent
Roberts et al.

(10) Patent No.: US 8,653,748 B2
(45) Date of Patent: Feb. 18, 2014

(54) ISOLATED CAPACITOR DRIVE CIRCUIT FOR THIN-FILM SOLID-STATE LIGHTING

(75) Inventors: Bruce Richard Roberts, Mentor-on-the-Lake, OH (US); Deeder Aurongzeb, Mayfield Hts., OH (US); Josip Brnada, Willoughby, OH (US)

(73) Assignee: General Electric Company, Schenectady, NY (US)

( * ) Notice: Subject to any disclaimer, the term of this patent is extended or adjusted under 35 U.S.C. 154(b) by 260 days.

(21) Appl. No.: 13/105,328

(22) Filed: May 11, 2011

(65) Prior Publication Data

US 2012/0286680 A1 Nov. 15, 2012

(51) Int. Cl.
*H05B 37/02* (2006.01)

(52) U.S. Cl.
USPC ..... 315/291; 315/307; 315/260

(58) Field of Classification Search
USPC ..... 315/291, 306, 307, 312, 260, 265, 272
See application file for complete search history.

(56) References Cited

U.S. PATENT DOCUMENTS

2004/0022058 A1* 2/2004 Birrell ..... 362/249
2007/0108921 A1* 5/2007 Matsushima ..... 315/307
2009/0159677 A1* 6/2009 Yakimov et al. ..... 235/439

FOREIGN PATENT DOCUMENTS

WO 02/31406 A1 4/2002

OTHER PUBLICATIONS

PCT Search Report and Written Opinion dated Nov. 8, 2012 from corresponding Application No. PCT/US2012/036449.

* cited by examiner

*Primary Examiner* — James H Cho
(74) *Attorney, Agent, or Firm* — Fay Sharpe LLP

(57) ABSTRACT

Solid-State lighting devices and fixtures are presented in which capacitor plates are formed in the fixture and in the lighting device to form AC coupling capacitors with one or more intervening dielectrics when the lighting device is placed in the fixture to power a driver circuit of the lighting device while providing a fixture with no exposed live wiring.

19 Claims, 6 Drawing Sheets

ISOLATED CAPACITOR DRIVE CIRCUIT FOR THIN-FILM SOLID-STATE LIGHTING

BACKGROUND OF THE DISCLOSURE

Solid-state lighting (SSL) devices, such as light emitting diodes (LEDs), organic light emitting diodes (OLEDs) and organic light emitting transistors (OLETs), are becoming a popular alternative to fluorescent and other more conventional forms of light sources, due to improved energy efficiency, thin form factor, and ease of adaptation for different shapes of lighting devices. SSLs are typically fabricated using thin-film technology, allowing the lighting device to be built as a thin, flexible structure. LEDs and OLEDs are driven by DC current, and thus fixtures for these devices must include driver circuitry to interface with conventional AC power sources. As these devices continue to be used in various lighting applications, new techniques and interconnection solutions are needed for powering SSL light sources.

SUMMARY OF THE DISCLOSURE

The present disclosure provides an isolated drive topology facilitating electrical and mechanical connection for thin-film solid-state lighting (SSL) devices in which a capacitor coupled AC circuit provides energy across an isolation barrier at the interface between the lighting device and an associated fixture. The secondary (device) side of the isolation circuit includes one or more rectifier components to rectify the AC signal in order to drive the SSL device(s) with DC current. The disclosure thus provides a safe, economical solution for powering flexible lighting devices in a simple and cost-effective manner, where the fixture can be entirely free of exposed live conductors. The isolated circuit can thus be easily disconnected without exposing a user to shock hazards, and the entire assembly can be simple and cost effective. The disclosure finds utility in a variety of possible applications, for instance, in which a non-rigid driver is incorporated into a flexible SSL light source. Such devices can be employed, for example, as illuminated wallpaper in which a base structure is part of a wall or ceiling structure (e.g., drywall, etc.) onto which the light source is glued or otherwise affixed. In addition, the disclosed lighting devices may be easily changed, for instance, allowing a user to change light colors seasonally and/or to accommodate updated room decoration themes. Moreover, where the SSL light source structure is flexible, applications are not limited to planar positioning of the lighting device.

One or more aspects of the disclosure are directed to a solid-state lighting device which includes a base structure constructed in whole or at least in part of and insulative material with two or more conductive plate structures facing outward of a first side of the base. The lighting device also includes a driver circuit with first and second AC input terminals connected to the plate structures as well as first and second DC output terminals providing power to a light panel with one or more solid-state light sources.

In certain embodiments, the first side of the base structure is planar. In certain embodiments, the first side of each plate structure is planar, and the first plate sides and the first base structure side may be coplanar. In some embodiments, moreover, the first plate side of each of the plate structures may be exposed. In other embodiments, the first plate side of each plate structure is covered with a dielectric material.

In certain embodiments, the driver circuit includes a rectifier with one or more diodes, such as a full bridge rectifier with for diodes in one example. In some embodiments, the rectifier diode or diodes are fabricated as one or more thin-film layers incorporated into the solid-state light source. In other embodiments, the diode or diodes are discrete devices.

In certain embodiments, the light panel includes one or more organic light emitting diode (OLED) type solid-state light sources coupled between the DC output terminals of the driver circuit.

A fixture is provided for a solid-state lighting device, which includes a base structure configured to receive a solid-state lighting device along a first base structure side, where the base structure is constructed in whole or at least in part of an insulative material. The fixture includes first and second plate structures positioned in the base structure, each being constructed of a conductive material and individually comprising a first plate side facing outwardly of the first base structure side and spaced inwardly therefrom, along with a connection for electrically coupling the plate structure to an AC power source.

In certain embodiments, the fixture base structure includes a recess for receiving the solid-state lighting device. In some embodiments, a gap between each of the first plate sides and the base structure first side is at least partially tilled with a dielectric material, such as the base structure material in certain implementations. In certain embodiments, moreover, the first base structure side and the first plate side of each of the plate structures are coplanar.

BRIEF DESCRIPTION OF THE DRAWINGS

One or more exemplary embodiments are set forth in the following detailed description and the drawings, in which.

DETAILED DESCRIPTION OF THE PREFERRED EMBODIMENTS

Figure 1:
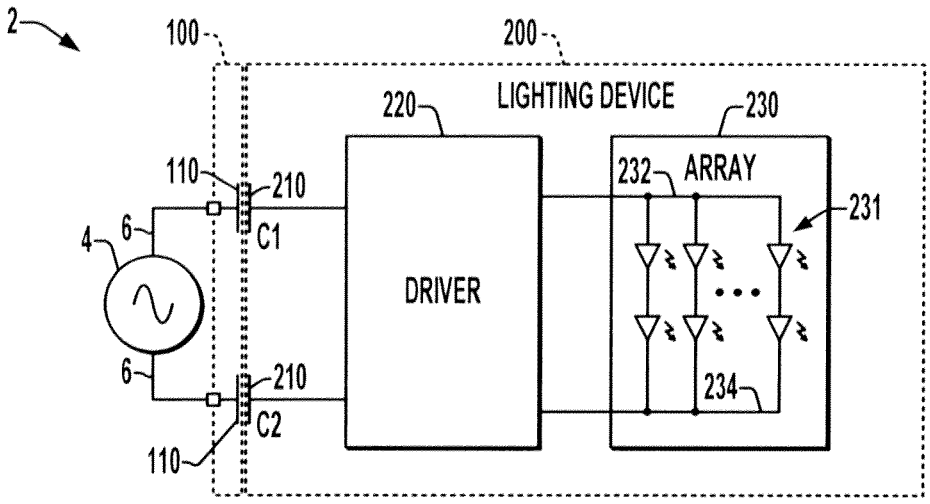
FIG. 1 is a schematic diagram illustrating a solid-state lighting system including a socket or fixture as well as an associated solid-state lighting device in which a pair of capacitor plates are formed in both the lighting device and in the fixture to form AC coupling capacitors for powering a driver of the lighting device when inserted into the fixture.

Referring now to the drawings, like reference numerals are used to refer to like elements throughout and the various features are not necessarily drawn to scale. A solid-state lighting (SSL) system 2 is shown in FIG. 1 which can be powered from a single or multiphase AC power source 4. The system 2 includes a fixture or light socket 100 providing connections 6 to the AC power source 4 and fixture plates 110 for providing AC coupling of power from the source 4 to a driver circuit 220 of an associated solid-state lighting (SSL) device 200. The SSL device 200 includes a solid-state lighting panel 230 with first and second DC power terminals 232 and 234, as well as one or more solid-state light sources 231. In certain embodiments, the SSL sources 231 are semiconductor based light emitting diodes (LEDs). In other embodiments, the light panel 230 includes one or more organic light emitting diodes (OLEDs), which can be connected in any suitable series and/or parallel circuit configuration between the DC connections 232 and 334. The panel, in other embodiments, can he any suitable form of solid-state lighting sources, including without limitation LEDs, OLEDs, and/or organic light emitting transistors (OLETs) or combinations thereof.

The SSL device 200 includes two or more conductive plate structures 210 situated to generally line up with the fixture plates 110 when the lighting device 200 is installed in the fixture or socket 100. When the fixture plates 110 and the lighting device plates 210 are oriented in the proper relative positions to one another, each pair of plates 110/210 forms an AC coupling capacitor (e.g., C1 and C2 in the schematic illustrations provided herein) which is used to couple AC input power from the source 4 to the driver circuit 210.

Figure 2:
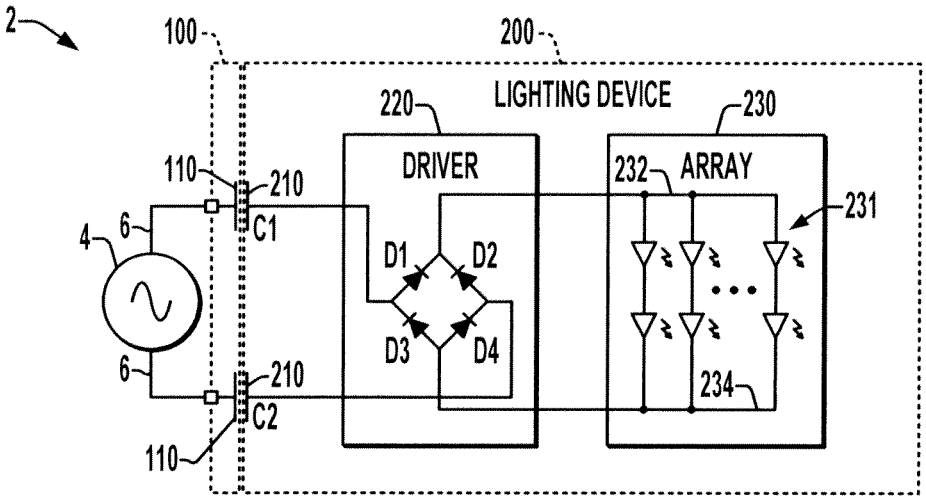
FIG. 2 is a schematic diagram illustrating an embodiment in which the driver circuit of the lighting device includes a full bridge rectifier formed by thin-film or discrete diodes.

Referring also to FIG. 2, the driver circuit 220 can be any suitable form of electrical circuit including one or more components by which DC output power is provided to the DC terminals 232 and 234 by conversion of AC input power received at the lighting device plates 210. In the example of FIG. 2, the driver 220 includes a rectifier circuit providing full wave rectification of input AC power using diodes D1-D4 connected as a full bridge rectifier. In other examples, a half wave rectifier can be provided, and even a simple single diode rectifier circuit can be used to convert the AC power into DC driver output power at the DC output terminals 232 in 234.

Figure 4:
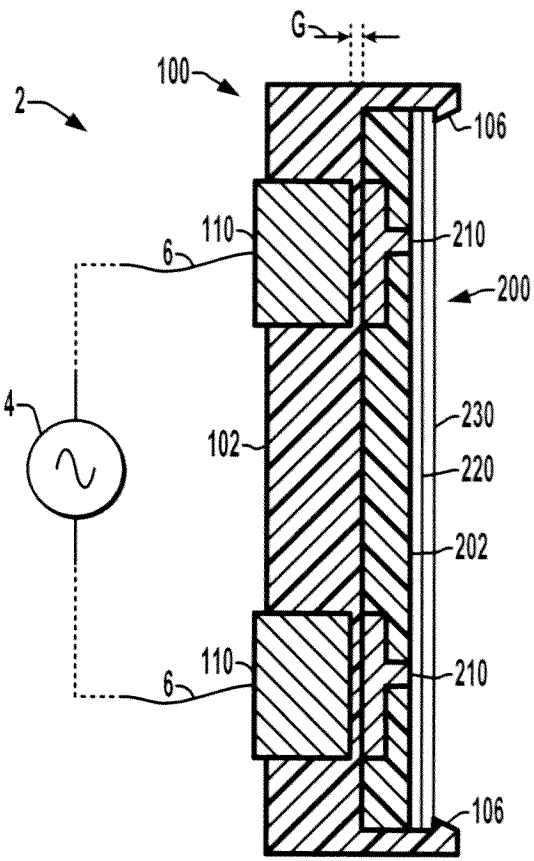
FIGS. 3 and 4 are sectional top plan views illustrating embodiments of the fixture and solid-state lighting device in separated and joined positions, respectively, in which the AC coupling capacitor dielectric is formed using insulative material of the fixture base.
Figure 3:
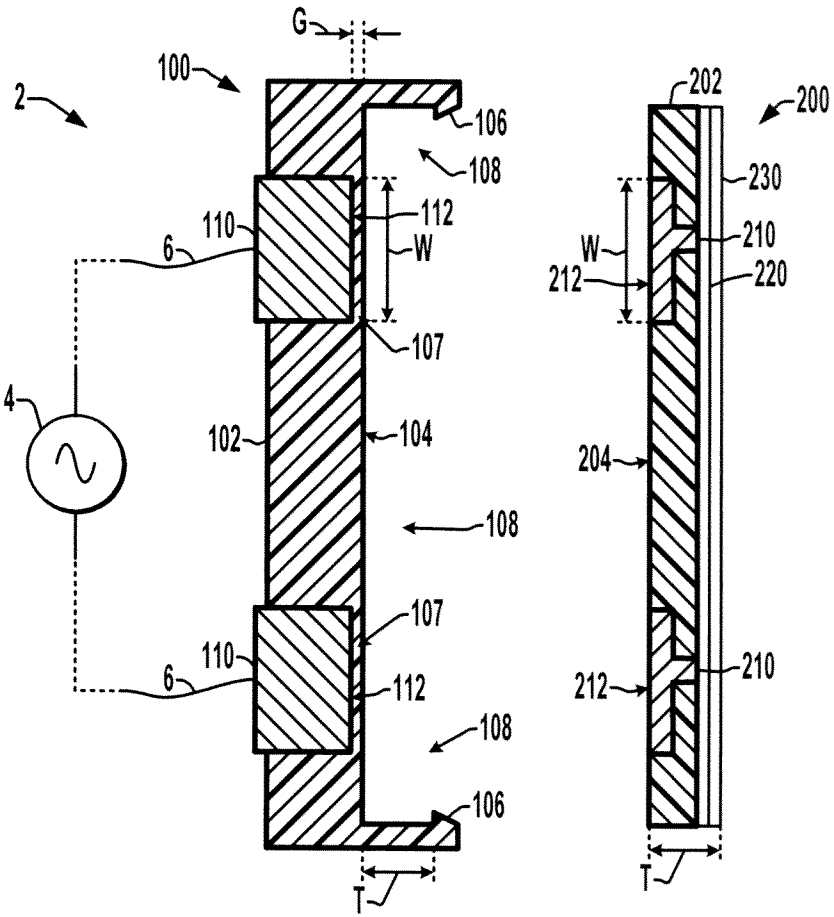
Figure 5:
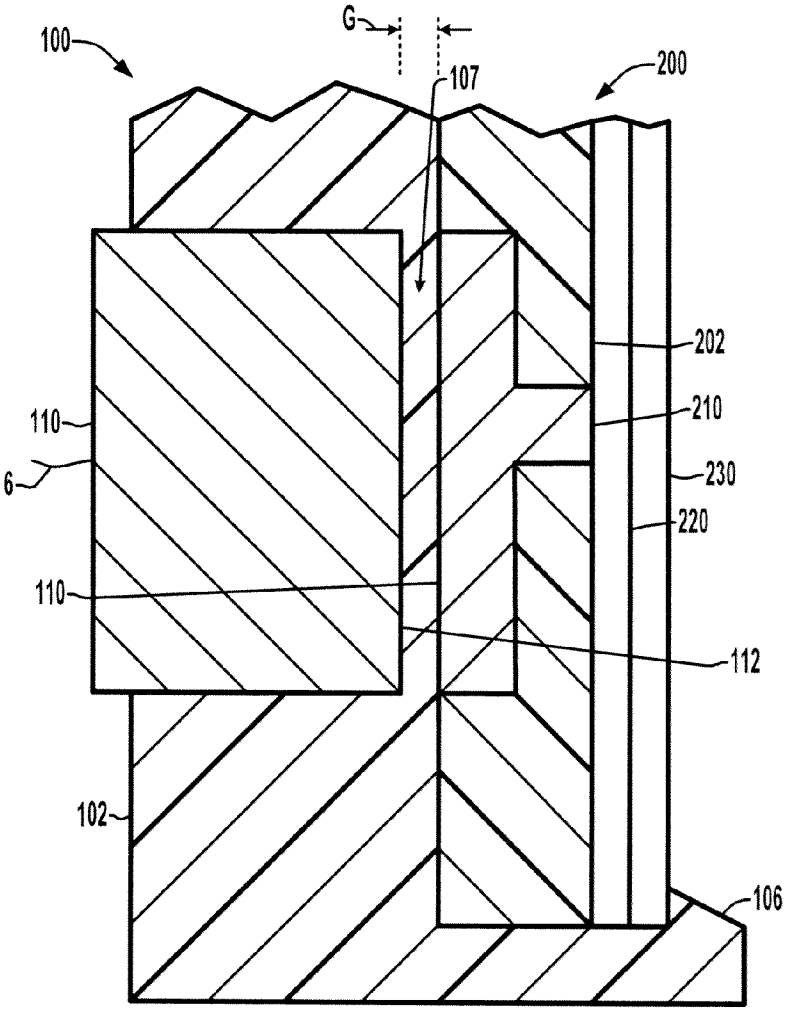
FIG. 5 is a partial sectional top plan view showing the fixture and solid-state lighting device of FIGS. 3 and 4, in which the gap between the AC coupling capacitor plates is filled with fixture base material.

Referring also to FIGS. 3-5, FIGS. 3 and 4 illustrate sectional top plan views of first embodiments of the fixture 100 and SSL lighting device 200. The fixture 100 and lighting device 200 are separated in the view shown in FIGS. 3, and the lighting device 200 is installed in the fixture 100 in FIG. 4. In these embodiments, the socket 100 includes a base structure 102 constructed in whole or in part of an insulative base structure material, such as plastic, which is formed so as to receive the SSL device 200. The structure 102 includes a planar first base structure side 104 that faces a recess 108 formed in the base structure 102 to receive the SSL device 200. The first side 104 in this example is generally planar, although other embodiments are possible in which the base structure 102 includes a curvilinear or other non-planar side 104 for interfacing with a corresponding side of an SSL lighting device 200. Other base structures 102 are possible which are formed to receive a solid-state lighting device 200, with or without a recess 108. In the example of FIGS. 3 and 4, the recess 108 has a thickness T generally commensurate with a thickness T of the SSL device 200.

The fixture 100 includes two or more plate structures 110 positioned in the base structure 102 with first plate sides 112 facing outwardly of the first base structure side 104 and spaced inwardly therefrom by a non-zero gap distance G. The plate structures 110 in the illustrated embodiment are generally equal size, including a width dimension W, and are generally cylindrical in form (e.g., FIG. 9 below), although other forms are possible, and the plate structures 110 may be different from one another. Moreover, three or more such plate structures 110 may be provided in certain embodiments, for instance, to connect with multiphase AC input sources 4. In addition, more than one plate structure 110 can be provided for each AC connection 6 in certain embodiments, whereby three or more plate structures 110 can be used even for single phase AC input sources 4.

Figure 6:
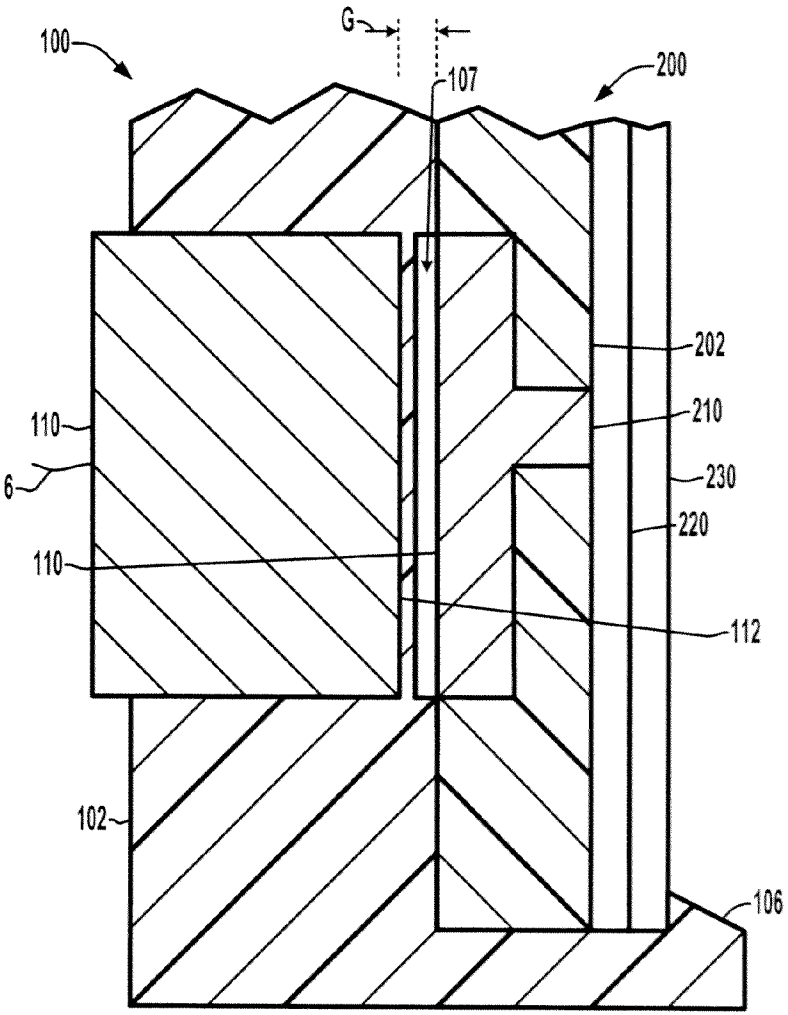
FIG. 6 is a partial sectional top plan illustrating another embodiment n which the AC coupling capacitor dielectric includes an insulator material portion formed using the fixture base material as well as an air gap portion.

As seen in FIG. 5, the fixture 100 provides a gap 107 between each of the first plate sides 112 of the plate structures 110 and the first base structure side 104. Although the gaps 107 are generally the same for each of the plates 110, different gaps can be used in other embodiments. In the example of FIG. 5, the gap 107 is substantially entirely filled with the insulative (e.g., plastic) material of the base structure 102, where the plate structures 110 in this embodiment can be formed as conductive inserts pressed into corresponding cavities formed in the base structure 102. In other embodiments, the gap 107 may be partially filled with the insulative material of the base structure 102, as shown in FIG. 6, where a portion of the gap 107 is filled with air. Other configurations are possible, wherein the base structure material 102 may extend in front of the first plate side 112 in coplanar fashion with the first base structure side 104, with an air gap being provided between the first plate side 112 and that portion of the base structure material 102. In other embodiments, the gap 107 is wholly or partially tilled with another dielectric material, such as an insert in the gap 107 (e.g., alone or in combination with an air gap), and/or a dielectric film (not shown) formed or installed on the first base structure side 104.

As also seen in FIG. 3, this embodiment of the SSL device 200 includes abuse structure 202 with a first base structure side 204 constructed in whole or at least in part of an insulative material (e.g., plastic). The device 200 in this example is a thin panel formed as multiple layers in a panel structure, including the base structure 202 as well as two or more thin film layers 220 and 230. In one example, the rectifier diodes D1-D4 are formed in a thin film layer structure 220 mounted to the base structure 202, and an OLED type panel structure 230 is formed or mounted onto the thin film layer 220. In other embodiments, the rectifier diodes D1-D4 of the driver circuit, and/or other driver circuit components (e.g., see FIGS. 11 and 12 below) can be formed in one or more such thin film layers 220 and/or may be discrete components mounted to a suitable structure of the device 200 and interconnected to form a corresponding driver circuit 220.

The lighting device 200 also includes a pair of conductive plate structures 210 positioned in the base structure 202. In this embodiment, the first base structure side 204 is planar, as are the first sides 212 of the plate structures 210. Moreover, the first plate sides 212 and the first base structure side 204 are coplanar in this embodiment, and the first plate side 212 of each of the plate structures 210 is exposed. The lighting device plate structures 210 are preferably located such that when the lighting device 200 is installed into the fixture 100, the lighting device plate structure first plate side 212 faces and is generally parallel with the first plate side 112 of the corresponding plate structure 110 in the fixture 100. In this manner, each plate pair 110/210 will form a capacitor C1, C2 via an intervening dielectric so as to allow coupling of AC input power from a source for to the driver circuit 220 of the lighting device 200. It is noted, in this regard, that while the coupling capacitors C1 and C2 in certain embodiments are generally of equal capacitance and are of similar size and configuration, this is not a requirement of the present disclosure, and the capacitors C1 and C2 may be of different value, different shapes, different sizes, and/or be fabricated using different materials, different plate-plate gap distances, etc.

Moreover, the corresponding plate structure pairs 110/210 are preferably located in a controlled, aligned position relative to one another. In the embodiment of FIGS. 3 and 4, this is accomplished by the provision of alignment structures 106, in this case retaining tabs formed as part of the base structure 102. In this manner, the provision of the recess 108 having thickness T in the fixture 100 and the general correspondence of the recess 108 with the size and form of the lighting device 200 allows the device 200 to be inserted and snap lit into the recess 108 as shown in FIG. 4 (see also FIG. 10 below). Thus installed, the dielectric gap between the plate pairs 110/210 has a dimension approximately equal to the gap distance G, which in turn, is controlled by the manufacturing of the socket 100. In this manner, the capacitance of the AC coupling capacitors C1 and C2 can be controlled in order to provide a desired amount of AC coupling between the source 4 and the driver 220.

The capacitors C1 and C2 are thus part of a safe, isolated connection scheme in which one plate 110 is connected to the power source 4 and the other plate 220 is connected to the driver circuit 220. Since the capacitor plates 110 and 210 are separated, the driver circuit 220 and the SSL device load 230 are isolated from line power. Moreover, when the lighting device 200 is removed from the fixture 100, the insulating material 102 provided in the gap 107 prevents a user from touching the conductive fixture plate structures 110, whereby all the user-accessible surfaces of the fixture 100 itself are electrically isolated from line power.

This architecture can be engineered for any voltage level and/or load current level required for a given lighting application. For instance, the capacitive reactants of the AC coupling capacitors C1 and C2 can be set by the size of the facing surfaces 112 and 212 of the fixture and lighting device plates 110 and 210, respectively. In this regard, for a given load current level (e.g., rated DC drive current value for a given OLED panel 230), and for a given voltage and frequency of the AC input source 4 (e.g., 120 V RMS at 60 Hz), the impedance $X_C=X_{C1+XC2}$ can be set, for instance, according to be following formulas (e.g., for the case where C1 and C2 are of equal capacitance):

$$I=Vac/X_C, \quad (1)$$

and $$X_C=1/(2\P fC), \quad (2)$$

where f=the AC frequency of the source for, and I=the desired drive current level.

The capacitance required for a given design is thus set by the design of the plate structures 110, 210, and also by the dielectric material formed in the gap 107. As seen in the example of FIG. 5, the gap 107 has a dimension G which can be controlled entirely in the manufacturing process for making the fixture base structure 102. Also, the dielectric constant of the selected a structure material 102 can be tailored through material selection in order to achieve a given desired capacitance value. In the example of FIG. 6, the thickness of the dielectric material 102 and the dimension of the air gap within the capacitor plate 107 can be tailored for a given desired capacitance value.

Figure 8:
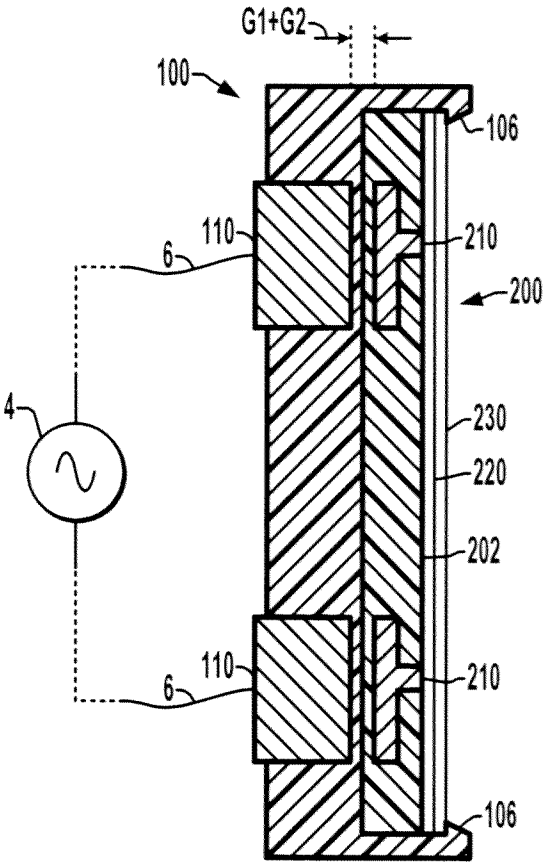
FIGS. 7 and 8 are sectional top plan views illustrating further embodiments of the fixture and solid-state lighting device in separated and joined positions, respectively, in which the AC coupling capacitor dielectric is formed using insulative materials of the fixture base and of the lighting device base.
Figure 7:
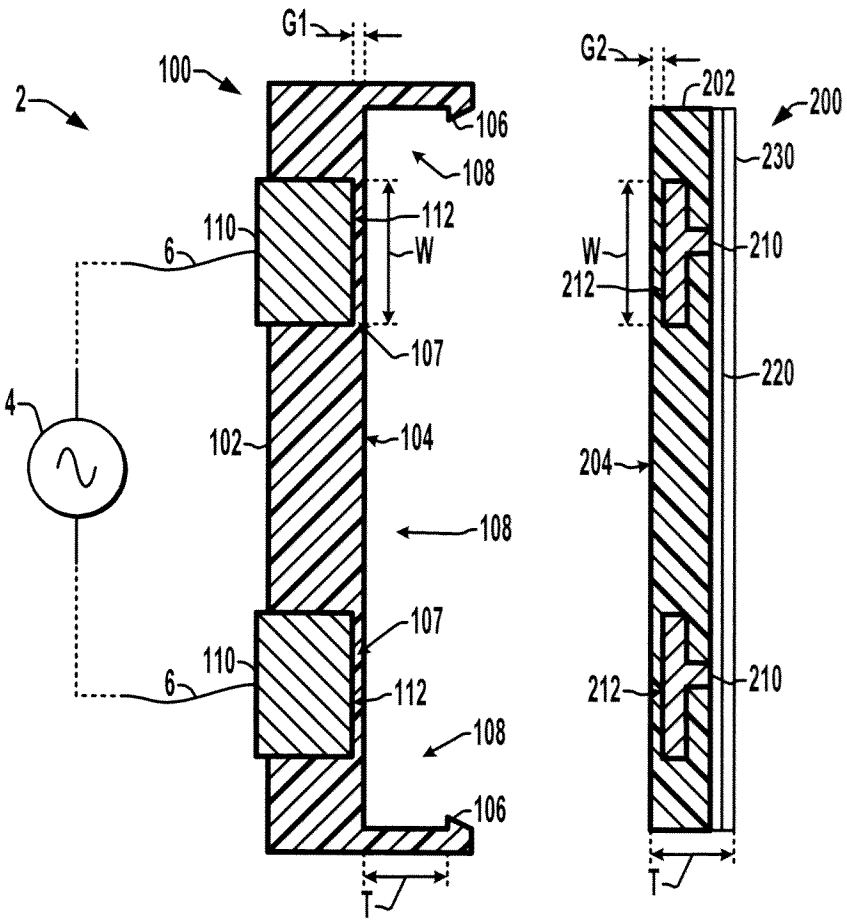

Referring also to FIGS. 7 and 8, another embodiment is illustrated in which the fixture 100 again has a gap 107 filled entirely with the insulative material of the basic structure 102, having a thickness G1 outlying the first plate faces 112 of the conductive fixture plate structures 110. In this embodiment, however, the plate structures 210 of the SSL device 200 include first plate sides 212 that are covered with a dielectric material. In one embodiment, as shown in the figure, this is done using the lighting device based material 202 (e.g., plastic in one example), having a thickness G2 as shown in FIG. 7. In other embodiments, a dielectric material layer (not shown) or coating can be installed over the plate side 212. As shown in FIG. 8, once the lighting device 200 is installed in the fixture 100, the effective plate-plate capacitor gap has a dimension of G1+G2, with the capacitor dielectric being determined by the thicknesses G1 and G2 as well as by the dielectric constants of the materials 102 and 202.

Figure 9:
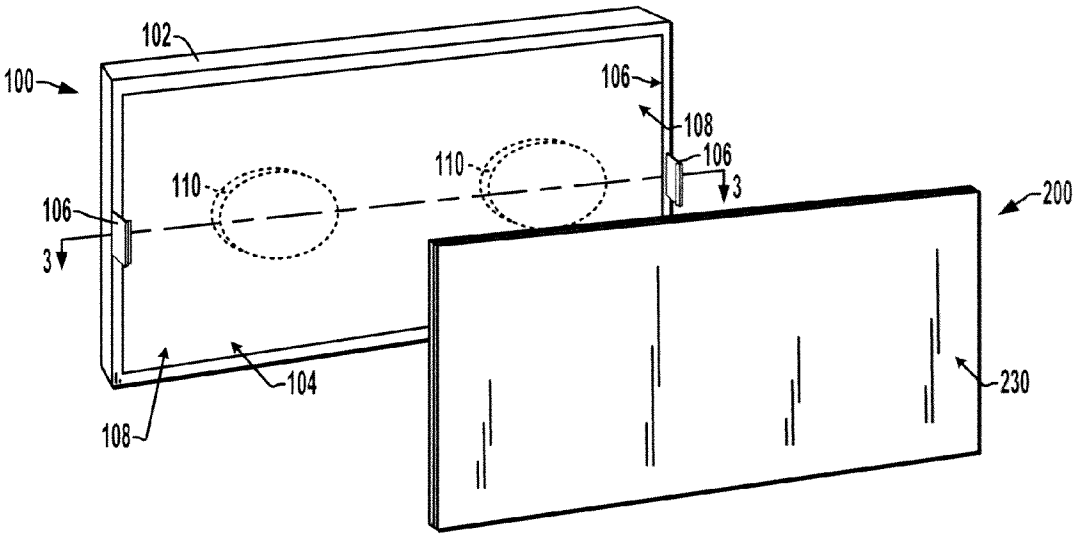
FIGS. 9 and 10 are perspective views illustrating removed and installed relative positions of the exemplary fixture and solid-state lighting device embodiments of FIGS. 3 and 4.
Figure 10:
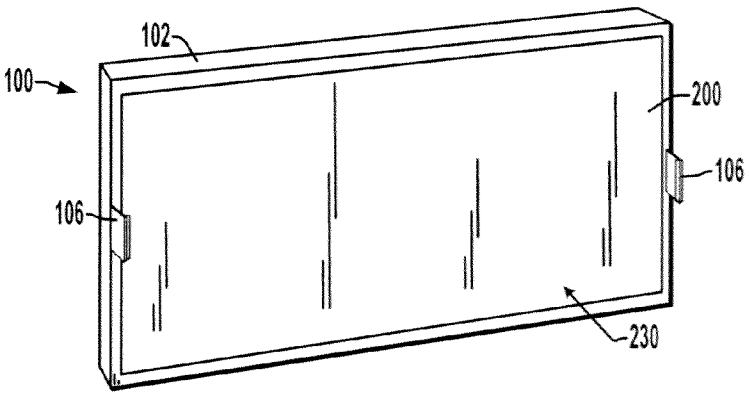

Referring also to FIGS. 9 and 10, in use, the illustrated embodiment of the fixture 100 may be a wall mount unit with suitable connections made to an AC source (not shown). In this regard, fixture units 100 can be constructed to utilize power from normal 120 V AC, 60 Hz sources 4, with the AC coupling capacitors C1 and C2 being designed accordingly depending on the power requirements of a given solid-state lighting device 200. It is noted, however, that other power distribution options exist, for example, with 120 V, 60 Hz AC power being converted by suitable rectifier/inverter units 4 to provide higher frequency AC power as an input source to the fixture 100. In this case, the capacitance for the coupling capacitor C1 and C2 could be smaller, thereby facilitating compact fixtures 100 and associated solid-state lighting devices 200 for lower power illumination applications. As seen in FIG. 9, the fixture 100 is mounted to a wall surface, and when no lighting device 200 is installed in the fixture 100, the fixture's plate structures 110 are covered by the base structure material 102, and thus are not physically accessible by a user. Therefor, a user may safely touch the fixture 100 even though the embedded plate structures 110 are connected to an AC source 4. The light source 200, in one example an OLED array, is then inserted into the recess 108 of the fixture 100 as shown in FIG. 10, with the alignment/retaining tabs 106 retaining the light source 200 within the recess 108 of the fixture 100, and also aligning the plate structures 210 of the light source 200 (not shown) with the plate structures 110 of the fixture 100.

Figure 11:
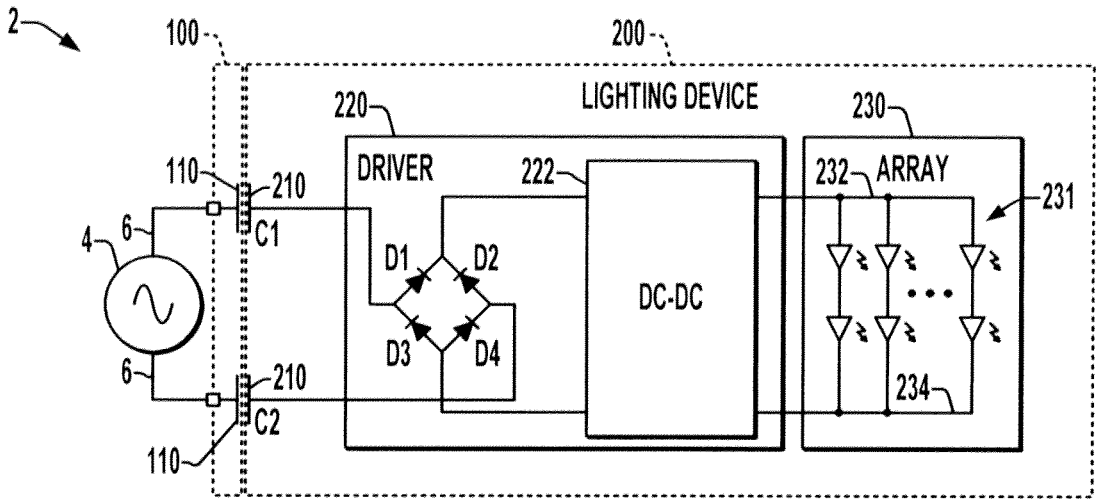
FIG. 11 is a schematic diagram illustrating another solid-state lighting device embodiment, in which the driver circuit includes a full bridge rectifier followed by a DC-DC converter circuit for driving an OLED light panel.

FIG. 11 illustrates another possible embodiment, in which the driver circuit 220 further includes a DC-DC converter circuit 222 coupled to the DC output terminals 232 and 234 of a full bridge rectifier circuit D1-D4. As mentioned above, the rectifier diodes D1-D4 and/or any additional circuitry of the DC-DC converter circuit 222 can be fabricated using thin-film technology as part of a multilayer lighting device structure including the solid-state light sources 231, for instance an array 230, along with the coupling capacitor secondary plate structures 210 for a thin form factor lighting device structure 200. Alternatively or in combination, any of the driver circuitry 220 can be fashioned using discrete circuit components alone or in conjunction with thin-film components and associated circuit interconnections. The embodiment of FIG. 11 facilitates use of general 120 V AC source power for low wattage lighting applications, wherein the DC-DC converter 222 can perform step down conversion, for instance, as a buck converter topology.

Figure 12:
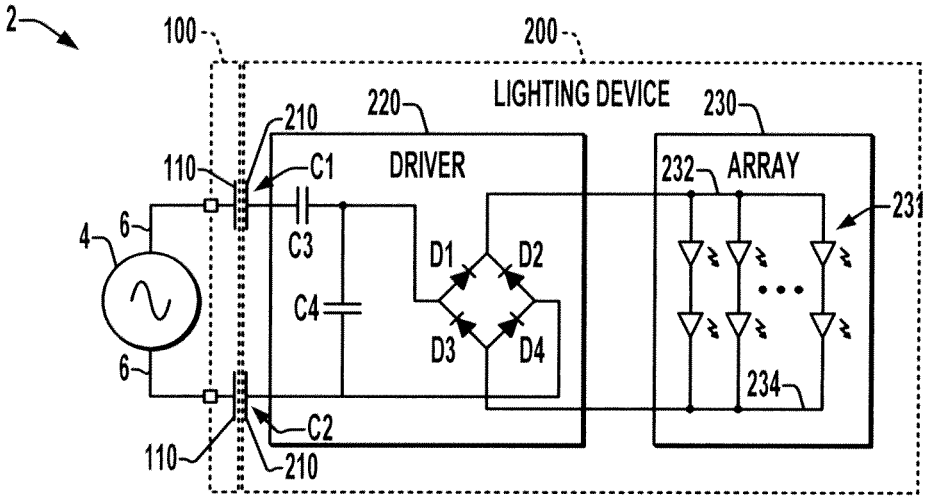
FIG. 12 is a schematic diagram illustrating yet another embodiment in which the driver circuit of the solid-state lighting device includes a capacitive divider circuit preceding the rectifier bridge.

FIG. 12 illustrates another exemplary embodiment in which the driver circuit 220 includes an input capacitive divider circuit including capacitors C3 and C4, with the center node joining capacitors C3 and C4 being connected as one of the AC input terminals of the full bridge rectifier circuit D1-D4. The divider capacitors C3 and C4 can be implemented as discrete devices in the lighting device structure 200 in certain embodiments. This arrangement also facilitates use of high-voltage AC sources (e.g., 120 V, 60 Hz) for low power lighting applications, with the resulting DC voltage provided at the DC output terminals 232 in 234 being tailored to provide the necessary DC drive current for a given solid-state light source panel 230.

The above examples are merely illustrative of several possible embodiments of various aspects of the present disclosure, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, processor-executed software, or combinations thereof, which performs the specified function of the described component (i.e., that is functionally equivalent), even though not structurally equivalent to the disclosed structure which performs the function in the illustrated implementations of the disclosure. Although a particular feature of the disclosure may have been illustrated and/or described with respect to only one of several implementations, such feature may be combined with one or more other features of the other implementations as may be desired and advantageous for any given or particular application. Furthermore, references to singular components or items are intended, unless otherwise specified, to encompass two or more such components or items. Also, to the extent that the terms "including", "includes", "having", "has", "with", or variants thereof are used in the detailed description and/or in the claims, such terms are intended to be inclusive in a manner similar to the term "comprising". The invention has been described with reference to the preferred embodiments. Obviously, modifications and alterations will occur to others upon reading and understanding the preceding detailed description. It is intended that the invention be construed as including all such modifications and alterations.

The invention claimed is:

1. A solid-state lighting device, comprising:

a base structure having a first base structure side, said base structure at least partially constructed of an insulative material;

first and second plate structures positioned in the base structure, the plate structures each constructed of a conductive material and having a first plate side facing outwardly of the first base structure side;

a driver circuit, comprising:

a first AC input terminal electrically coupled with the first plate structure, a second AC input terminal electrically coupled with the second plate structure, and a first and second DC output terminals, the driver circuit operative to convert AC input power received at the AC input terminals to provide DC output power at the DC output terminals;

a light panel comprising at least one solid-state light source coupled between the first and second DC output terminals of the driver circuit, the light panel operative to provide light output when DC power is provided at the DC output terminals of the driver circuit, wherein the first plate side of each of the plate structures is exposed through an opening in the first base structure side of the base structure.

2. The solid-state lighting device of claim 1, wherein the first base structure side is planar.

3. The solid-state lighting device of claim 2, wherein the first plate side of each of the plate structures is planar.

4. The solid-state lighting device of claim 3, wherein the first plate side of each of the plate structures and the first base structure side are co-planar, and wherein the first plate side of each of the plate structures is exposed.

5. The solid-state lighting device of claim 3, wherein the first plate side of each of the plate structures is covered with a dielectric material.

6. The solid-state lighting device of claim 3, wherein the driver circuit comprises a rectifier circuit including at least one diode.

7. The solid-state lighting device of claim 6, wherein the driver circuit comprises a full bridge rectifier circuit with four diodes.

8. The solid-state lighting device of claim 6, wherein the at least one diode is fabricated as one or more thin film layers incorporated into the at least one solid-state light source.

9. The solid-state lighting device of claim 6, wherein the at least one diode is a discrete device.

10. The solid-state lighting device of claim 2, wherein the light panel comprises at least one organic light emitting diode coupled between the first and second DC output terminals of the driver circuit.

11. A solid-state lighting device, comprising:

a base structure having a first base structure side, said base structure at least partially constructed of an insulative material;

first and second plate structures positioned in the base structure, the plate structures each constructed of a conductive material and having a first plate side facing outwardly of the first base structure side;

a driver circuit, comprising:

a first AC input terminal electrically coupled with the first plate structure, a second AC input terminal electrically coupled with the second plate structure, a first and second DC output terminals, the driver circuit operative to convert AC input power received at the AC input terminals to provide DC output power at the DC output terminals; and a light panel comprising at least one solid-state light source coupled between the first and second DC output terminals of the driver circuit, the light panel operative to provide light output when DC power is provided at the DC output terminals of the driver circuit;

wherein the driver circuit comprises a rectifier circuit including at least one diode; and wherein the at least one diode is fabricated as one or more thin film layers incorporated into the at least one solid-state light source; and wherein the first plate side of each of the plate structures is exposed through an opening in the first base structure side of the base structure.

12. The solid-state lighting device of claim 11, wherein the driver circuit comprises a full bridge rectifier circuit with four diodes.

13. The solid-state lighting device of claim 11, wherein the at least one diode is a discrete device.

14. The solid-state lighting device of claim 11, wherein the light panel comprises at least one organic light emitting diode coupled between the first and second DC output terminals of the driver circuit.

15. A fixture for a solid-state lighting device, comprising:

a base structure configured to receive a solid-state lighting device along a first base structure side, said base structure at least partially constructed of an insulative base structure material; and first and second plate structures positioned in the base structure, the plate structures each constructed of a conductive material and individually comprising:

a first plate side facing outwardly of the first base structure side and spaced inwardly from the first base structure side by a non-zero distance, and a connection electrically coupled with the plate structure for electrically coupling the plate structure to an AC power source.

16. The fixture of claim 15, wherein the base structure comprises a recess for receiving the solid-state lighting device.

17. The fixture of claim 15, comprising a gap between each of the first plate sides of the plate structures and the first base structure side, wherein the gap is at least partially filled with a dielectric material.

18. The fixture of claim 15, comprising a gap between each of the first plate sides of the plate structures and the first base structure side, wherein the gap is at least partially filled with the insulative base structure material.

19. The fixture of claim 15, wherein the first base structure side is planar, wherein the first plate side of each of the plate structures is planar, and wherein the first plate side of each of the plate structures and the first base structure side are coplanar.

* * * * *